United States Patent [19]

Bagepalli et al.

[11] Patent Number: 4,975,031

[45] Date of Patent: Dec. 4, 1990

[54] ROTARY COMPRESSOR WITH COMPLIANT IMPACT SURFACES

[75] Inventors: Sampathkumaran Bagepalli; Imdad Imam, both of Schenectady, N.Y.

[73] Assignee: General Electric Company, Schenectady, N.Y.

[21] Appl. No.: 294,722

[22] Filed: Jan. 9, 1989

[51] Int. Cl.[5] ..... F04C 18/356

[52] U.S. Cl. ..... 418/63; 418/156; 418/157

[58] Field of Search ..... 418/63, 156, 157, 248, 418/65, 243-247, 249, 251, 153

[56] References Cited

U.S. PATENT DOCUMENTS

| | | | |
|---|---|---|---|
| 2,476,383 | 7/1949 | Porteous | 418/63 |
| 4,580,957 | 4/1986 | Fickelscher et al. | 418/63 |
| 4,743,182 | 5/1988 | Schabert | 418/63 |

FOREIGN PATENT DOCUMENTS

| | | | |
|---|---|---|---|
| 63-277883 | 11/1988 | Japan | 418/63 |
| 20728 | 11/1929 | Netherlands | 418/63 |
| 1250714 | 8/1986 | U.S.S.R. | 418/63 |

OTHER PUBLICATIONS

Sano et al., 1984 International Compressor Engineering Conference,' "Analysis of Hermetic Rolling Piston Type Compressor Noise, and Countermeasures", pp. 242-250, 1984.

*Primary Examiner*—John J. Vrablik

*Attorney, Agent, or Firm*—Paul R. Webb, II; James C. Davis, Jr.

[57] ABSTRACT

Objectionable noise in a rotary compressor is reduced by placing cavities in the sliding vane and/or the rolling piston. The cavities are used to change the local compliance of surfaces which impact one another to generate the objectionable noise. The change in the compliance of impacting surfaces is used to change the frequency of the noise generated by the impacting surfaces.

19 Claims, 4 Drawing Sheets

ROTARY COMPRESSOR WITH COMPLIANT IMPACT SURFACES

BACKGROUND OF THE INVENTION

The present invention relates to rotary compressors. More specifically, the present invention relates to a rotary compressor having impact surfaces adapted to reduce objectionable noise.

A rotary type of compressor as commonly used for refrigerators and air conditioners often generates high frequency noise. Indeed, some refrigerators use rotary compressors which show a strong almost pure tone noise of about 4 khZ. As the human ear is quite sensitive to noise at this frequency, such noise is quite objectionable.

Various methods of reducing rotary compressor noise have previously been considered.

One approach is to redesign the casing of the rotary compressor so as to reduce the sound radiation from it. The noise heard by the human ear results from the vibration of the casing which encloses the whole compressor structure. Modifying the sound radiation pattern is necessary for this approach. The radiation can be modified by changing the bending rigidity of the compressor, i.e., changing the casing thickness or adding stiffness to the casing. However, redesigning the casing is relatively expensive and is therefore undesirable.

Another way of attenuating the compressor noise is by controlling the compressor gas spectrum. Any resonator type of device built into the discharge port works as a mechanical filter. This may adversely effect the compressor efficiency depending on the structure of the resonator.

Other attempts to reduce the high frequency noise have included changes in orifice design, clearances, and root radii. These changes have been only partially successful and are somewhat disadvantageous in that they often reduce the efficiency of the compressor.

Although the above approaches at noise reduction have been somewhat useful, there remains a need for significantly and inexpensively reducing the objectionable noise from a rotary compressor without reducing the efficiency of the compressor.

OBJECTS AND SUMMARY OF THE INVENTION

Accordingly, it is a primary object of the present invention to provide a new and improved rotary compressor.

A more specific object of the present invention is to provide a rotary compressor having a noise reduction arrangement which is relatively easy and inexpensive to implement.

A further object of the present invention is to provide a noise reduction arrangement for a rotary compressor which has little or no detrimental effect on the compressor efficiency.

Yet another object of the present invention is to provide a noise reduction arrangement for a rotary compressor which does not adversely affect the friction and wear of the components.

The above and other objects of the present invention which will become more apparent as the description proceeds are realized by a rotary compressor having a cylindrical wall and a compression chamber within the cylindrical wall. The compression chamber has a width. A rolling piston is mounted for eccentric rotation about a rotation axis within the cylindrical wall, the rotation axis being parallel to the width of the compression chamber. A vane is slidably mounted in a slot in the cylindrical wall. The vane has a tip impacting an external surface of said rolling piston. The rolling piston also has an internal surface. The rotary compressor has a cavity operable to affect the compliance of impact surfaces at the site of impact between the tip of the vane and the rolling piston. As used herein, "compliance" refers to the ability of a surface of a component to yield or bend under load (i.e., without causing a movement of other portions of the component). Generally, a less rigid structure is more compliant than a structure of greater rigidity. The cavity is disposed outwardly from the internal surface of the rolling piston. The cavity extends substantially in the direction of the width of the compression chamber, meaning that it extends at least ten percent of the width. The cavity is disposed in a component selected from the group including the vane and the rolling piston. The cavity extends in the width direction completely across the width of the compression chamber and completely through the selected component. The cavity is hollow in one embodiment. The cavity is filled with a fixed filler to affect the compliance of the impact surfaces in another embodiment. The cavity is bounded by the selected component in a closed loop in any cross-section taken in a plane perpendicular to the rotation axis. In the embodiment where the cavity is disposed in the vane, the cavity is a hole disposed in the tip of the vane. The rolling piston may include a plurality of slots disposed between the internal surface of the rolling piston and the external surface of the rolling piston. If the cavity is disposed in the rolling piston, the cavity is a slot in the rolling piston.

For the embodiment where the cavity is disposed in the tip of the vane, the cavity is bounded by the vane in a closed loop in any cross-section taken in a plane perpendicular to the rotation axis. The cavity extends in the width direction completely across the width of the compression chamber and completely through the vane. The cavity is hollow for a particular embodiment wherein the cavity is disposed in the vane. An alternate embodiment having the cavity disposed in the vane has the cavity offset from a vane center line and wherein the cavity has a center line closer to the compression chamber than the vane center line. Yet another embodiment having the cavity in the vane has the cavity filled with a fixed filler to affect the compliance of the impact surfaces. The cavity may more specifically be recited as a cylindrical hole having a central axis parallel to the rotation axis.

In the embodiment wherein the cavity is disposed within the rolling piston, the cavity is disposed between the external surface of the rolling piston and the internal surface of the rolling piston. The cavity is enclosed by the rolling piston in a closed loop in any cross-section taken in a plane perpendicular to the rotation axis. The cavity may more specifically be described as a slot and the rolling piston further includes a plurality of additional slots between the external surface and the internal surface. Each of the additional slots is operable to affect the compliance of impact surfaces at the site of impact between the tip of the vane and the rolling piston. Each of the additional slots is enclosed by the rolling piston in a closed loop in any cross-section taken in a plane perpendicular to the rotation axis. The tip of the vane may also include a hole operable to affect the compliance of impact surfaces at the site of impact between the tip of the vane and the rolling piston. The hole is enclosed by the vane in a closed loop in any cross-section taken in a plane perpendicular to the rotation axis. Each of the slots extends in the width direction completely across the width of the compression chamber and completely through the rolling piston.

BRIEF DESCRIPTION OF THE DRAWINGS

The above and other features of the present invention which will become more apparent as the description proceeds are best understood by considering the following detailed description in conjunction with the accompanying drawings wherein like characters represent like parts throughout the several views and in which.

DETAILED DESCRIPTION

Figure 1:
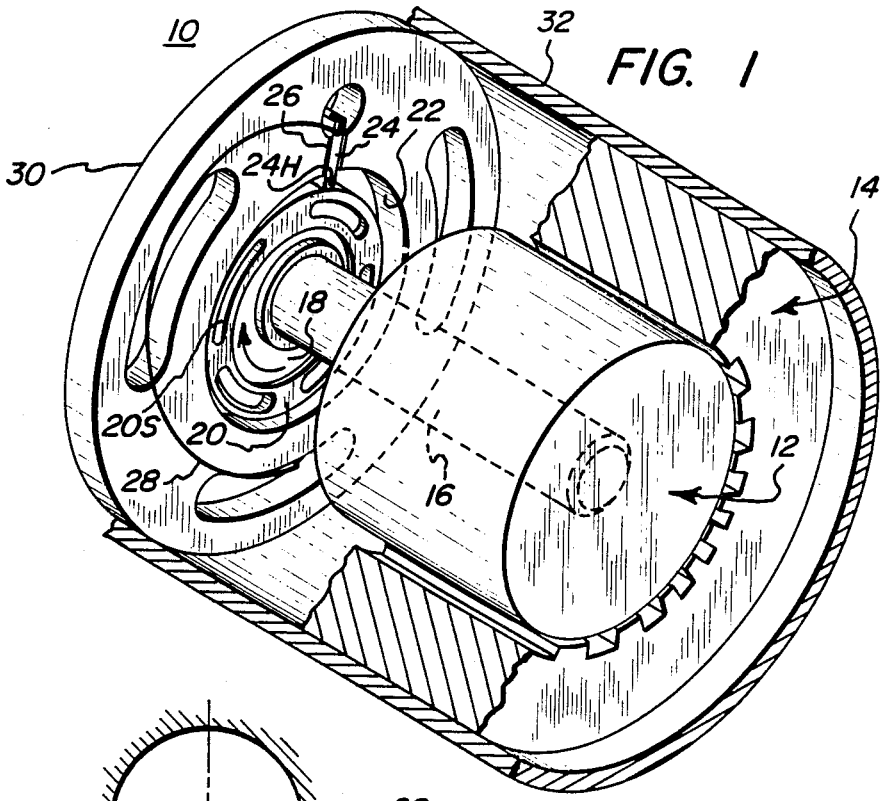
FIG. 1 is a simplified perspective with parts broken away of a rotary compressor of the present invention.

The overall construction of the rotary compressor 10 of the present invention will be initially described with reference to FIG. 1. The compressor 10 includes a motor having rotor 12 and stator 14 which operate in known fashion to rotate a shaft 16. An eccentric 18 is attached to the shaft 16 and a roller or rolling piston 20 surrounds the eccentric 18. The rolling piston 20 rotates eccentrically relative to the cylindrical wall 22. A vane 24 is disposed in a slot 26 in the cylindrical wall 22. A spring 28 is used to bias the slidable vane 24 inwardly. The cylindrical wall is part of a cylinder 30 which may be constructed of cast iron or other materials and include the illustrated slots to hold down the weight in known fashion. A casing 32 surrounds the structure.

Figure 2:
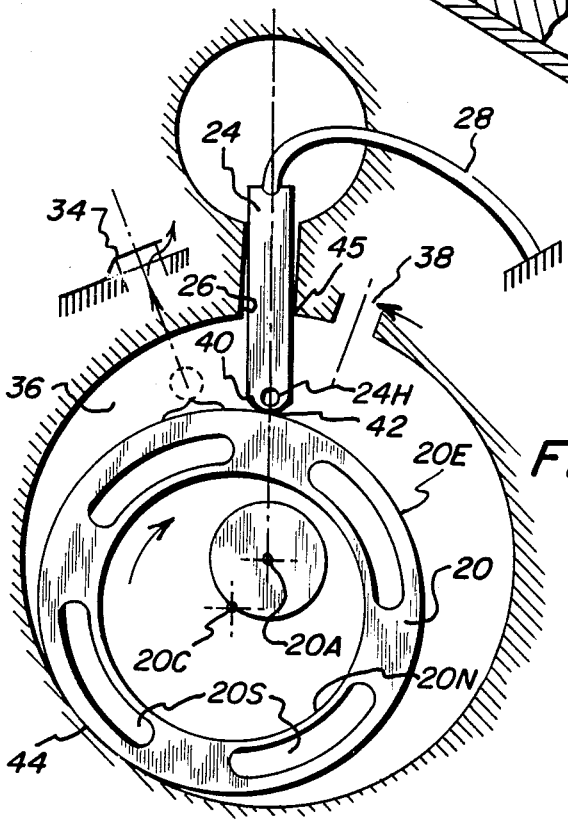
FIG. 2 is a simplified planar view with some parts depicted schematically of a rotary compressor according to the present invention.

With reference now to FIG. 2, a discharge valve 34 is used to control the discharge of compressed gas from compression chamber 36. A suction port 38 is used to allow the refrigerant to enter into the cylindrical walls 22.

The general principles of operation of the components discussed above are well known. The discussion which follows will emphasize unique features with respect to the rolling piston 20 and the vane 24 as the other components are known structures.

As shown in FIG. 2, the rolling piston 20 rotates about a rotation axis 20A which is offset from a center axis of symmetry 20C of the roller or rolling piston 20. The roller 20 includes a plurality of slots 20S disposed circumferentially around the roller 20. In the embodiment of FIG. 2, each of the slots 20S is a cavity which extends completely across the width (i.e., direction parallel to rotation axis 20A) of the compression chamber 36 and completely through the rolling piston 20A. Each of the slots 20S constitutes a cavity which would be bounded by opposite end plates (not shown) which would be disposed at opposite ends of the rolling piston 20 in known fashion. The slots 20S may be of equal length and may be evenly spaced around the circumference of the rolling piston 20. Alternately, the slots 20S could be disposed in a less symmetrical manner in order to best reduce noise as discussed in more detail below.

It should be noted that each of the slots 20S is disposed outwardly from an internal cylindrical surface 20N of the rolling piston 20 and each of the slots 20S is disposed inwardly from an external cylindrical surface 20E of the rolling piston 20. Each of the slots 20S is bounded by the rolling piston 20 in a closed loop in any cross-section taken in a plane perpendicular to the rotation axis 20A. In other words, the plane of view of FIG. 2 or any parallel plane of view would show each of the slots 20S to be bounded around 360° by the rolling piston 20.

Continuing to view primarily FIG. 2, the vane 24 includes a hole 24H disposed at the tip 40 of the vane 24. The hole 24H extends completely across the width of the compression chamber 36 and completely through the vane 24. The hole 24H is a cylindrical hole having a center line or axis of symmetry (not separately labeled in FIG. 2) parallel to the rotation axis 20A. The opposite ends of the hole 24H would be bounded by end plates (not shown) as commonly used to enclose opposite ends of the compression chamber of a rotary compressor. In similar fashion to the bounding of the slots 20S by the rolling piston 20 when taken in a cross-section view of a plane parallel to the plane of view of FIG. 2, the hole 24H in the vane 24 is bounded by the vane 24 in a closed loop in any cross-section taken in a plane perpendicular to the rotation axis 20A, such as the viewing plane.

One of the major potential sources for noise of about 4 khZ in a rotary compressor is considered to be the impacts occurring between the vane 24 and the roller or rolling piston 20 and between the rolling piston 20 and the cylindrical wall 22. By the addition of the slots 20S and the hole 24H, the objectionable noise should be reduced. In particular, the addition of the cavities such as slots 20S and hole 24H provides additional localized compliance (i.e., lessens the rigidity of the impact surfaces of the components). The impacts between the tip 40 of vane 24 and the external surface 20E of roller 20 is at point 42, whereas the impact between the external surface 20E and the cylindrical wall 22 is at point 44 in FIG. 2. (A further impact point or area 45 is between vane 24 and the side of slot 26. If desired, a second hole, not shown, could be disposed in vane 24 to be adjacent to impact 45 when the vane 24 is fully extended.) By making the vane 24 and roller 20 less rigid immediately adjacent to the impact surfaces, the objectionable noise will be reduced.

As clearly shown in FIG. 2, the rolling piston 20 is of integral construction between and including its external surface 20E and its internal surface 20N. In other words, the external surface 20E and the internal surface 20N and the rolling piston portions therebetween are not separate or distinct parts which have been fixed together. As also shown in FIG. 2, the vane 24 is of integral construction between and including opposite sides (i.e., right and left sides in view of FIG. 2) which slide directly adjacent opposite sides of the slot 26.

As the slots 20S and the hole 24H are bounded by end plates in the manner discussed above, it will be readily appreciated that the slots 20S and the hole 24H are non-communicating cavities in that they do not serve as conduits.

Figure 3:
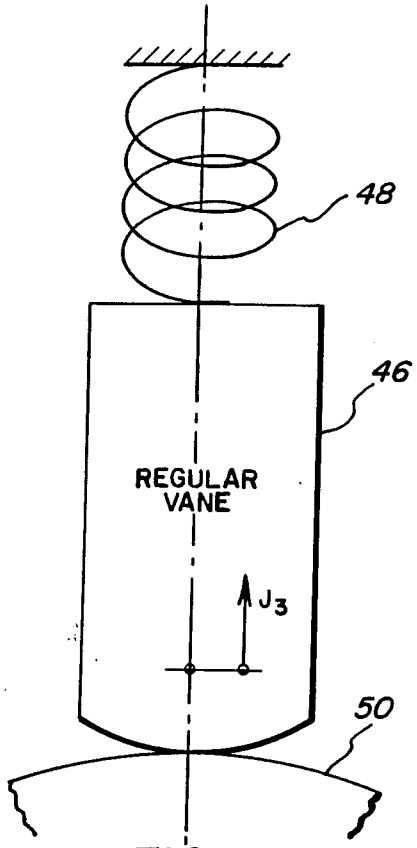
FIG. 3 PRIOR ART
FIG. 3 shows a mathematical model of a test arrangement for a prior art vane structure.

With reference now to FIG. 3, there is shown a model test procedure which was analyzed to test a regular vane 46 (i.e., a solid vane having no cavities for added compliance). In particular, the model has a vane 46 biased by a spring 48 and made to bear against and impact a surface 50 similar to the external surface of a rolling piston of a rotary compressor. The accelerations of the vane as determined by a mathematical analysis are shown in FIG. 4 and approximate a frequency of 5 khZ.

Figure 6:
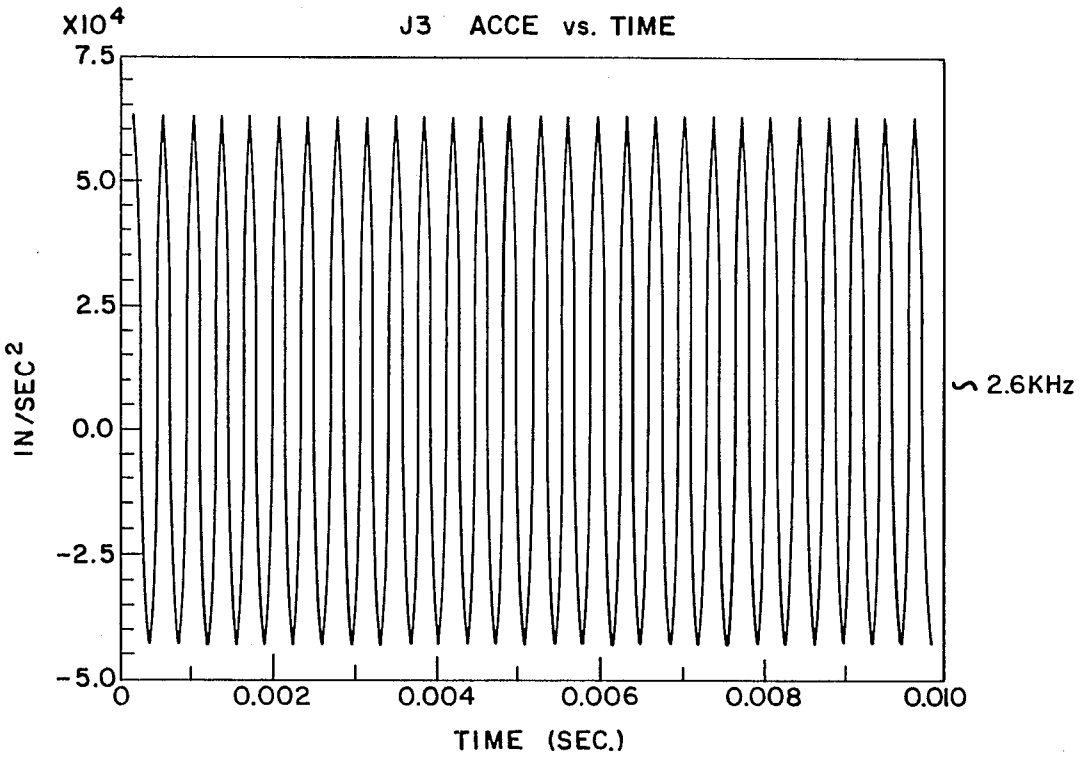
FIG. 6 shows simulated acceleration data from analysis of the model of FIG. 5.
Figure 5:
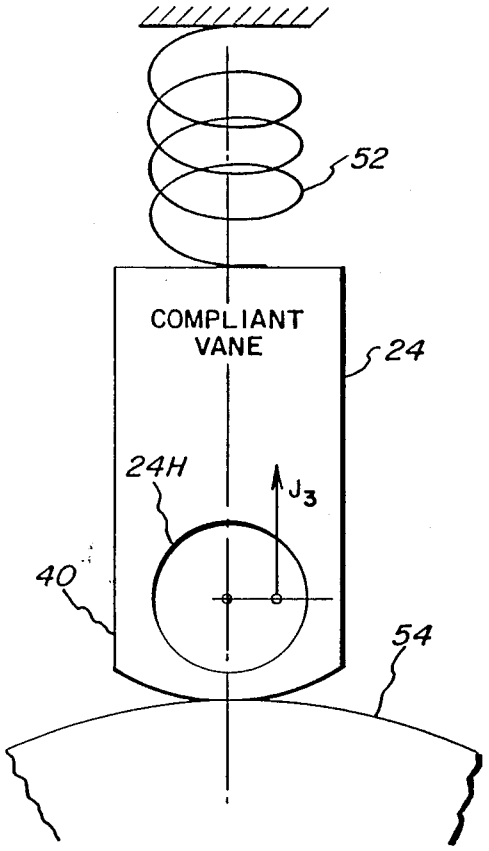
FIG. 5 shows a mathematical model of a test arrangement for a compliant vane according to the present invention.

With reference now to FIG. 5, a model uses a compliant vane 24 having a tip 40 with a hole 24H disposed therein and a spring 52 and a surface 54 in similar fashion to the test of FIG. 3. As shown by FIG. 6, the accelerations of the vane have an approximate frequency of 2.6 khZ as determined by mathematical analysis.

Figure 4:
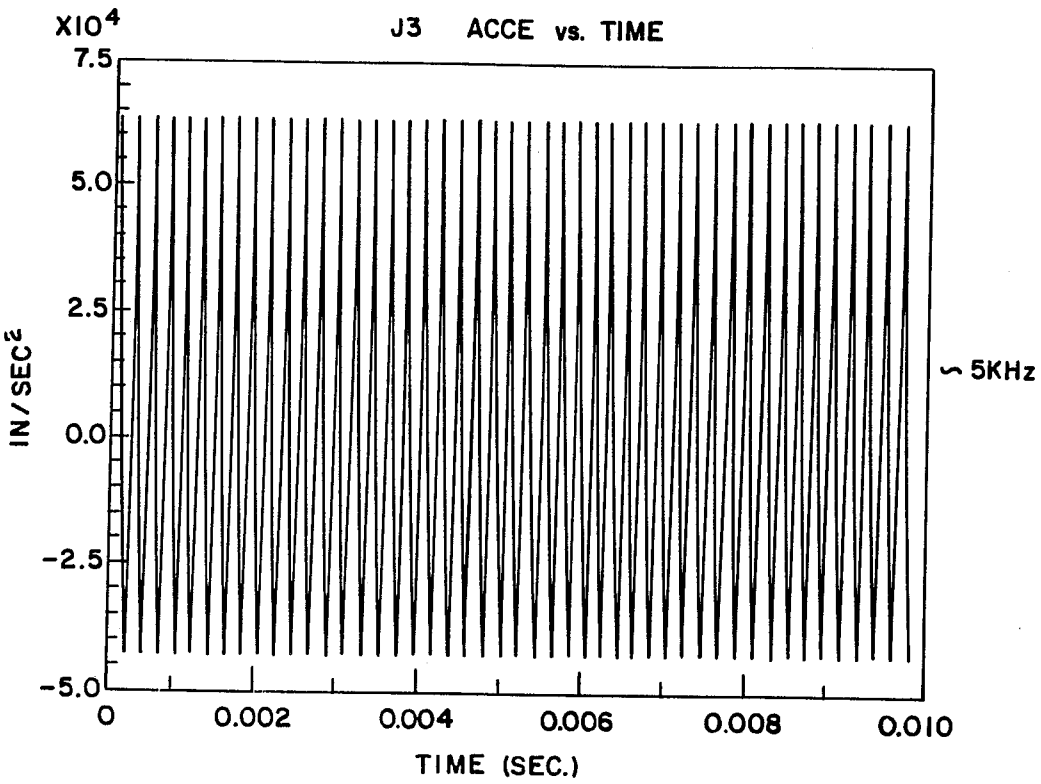
FIG. 4 PRIOR ART
FIG. 4 shows simulated acceleration data from analysis of the model of FIG. 3.

Comparing FIG. 4 and FIG. 6, it will be appreciated that the vane having the compliance-providing hole 24H disposed therein has approximately cut the frequency of accelerations in half. By cutting the frequency of the accelerations almost in half, the frequency of noise from the impact between the vane and the rolling piston would likewise be substantially reduced and, therefore, be moved substantially away from the frequency to which the human ear is most sensitive. It should further be noted that the models of FIG. 3 and FIG. 5 did not simulate the effect of including slots in the rolling piston. However, such slots should provide additional reduction of the frequency and corresponding reduction of the noise component which is most objectionable.

Although one could also lower the noise of the impact between the surfaces of the rotary compressor by making the surfaces from more resilient materials than the usual metallic materials, such a change in materials may result in additional friction and/or additional wear on the materials. For example, use of a rubber layer on the tip of the vane might reduce the noise, but it is unlikely that such a rubber layer would hold up under regular use. The present invention provides improved compliance while retaining the same surface hardness for the impacting surfaces. Additionally, the use of the cavities to change the compliance of the impact surfaces according to the present invention avoids a reduction in durability of the surfaces and possible increase in friction of the surfaces which may result from a change in the material of the actual impact surfaces themselves.

The use of the compliance changing cavities of the present invention are further advantageous in that they may be inexpensively implemented by simply drilling a hole in the sliding vane and drilling a series of holes in the rolling piston in order to provide the slots. Although the above discussion of the preferred embodiments has used a hole 24H and slots 20S which extend completely through the respective vane and roller piston, the hole 24H and slots 20S could alternately extend only partly through the corresponding component.

As mentioned previously, the slots 20S may be arranged of equal length and equally spaced. However, as the noise generated by the impact between the vane 24 and the roller 20 may vary depending upon which stage of the cycle the roller 20 is disposed in, the slots 20S could alternately be positioned so as to provide the increased compliance when the roller 20 is at particular angles where the objectionable noise is most likely to be generated.

The slots 20S and hole 24H are of course located sufficiently close to the impact surfaces to provide a significant change in the compliance of the impact surfaces.

Figure 7:
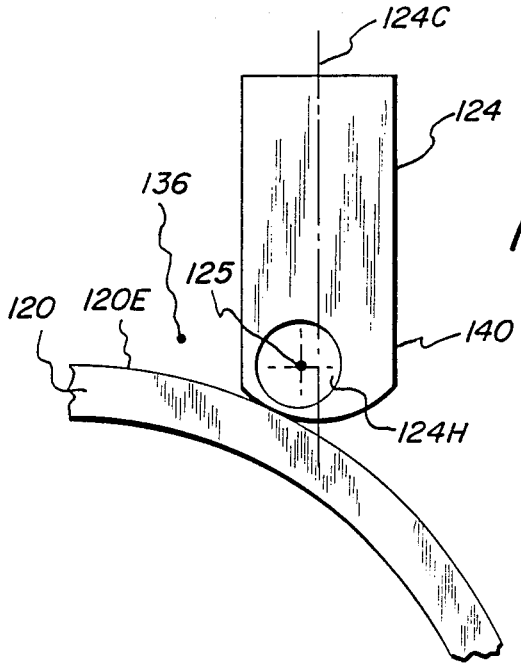
FIG. 7 shows an alternate embodiment vane having an eccentric hole.

With reference now to FIG. 7, an alternate embodiment vane 124 is illustrated. The components of FIG. 7 are labeled in the "100" series with the same last two digits as the corresponding component, if any, from FIG. 2. The vane 124 has a vane center line 124C and a hole 124H disposed in the tip 140 of the vane. The hole 124H includes a central axis of symmetry 125 which is perpendicular to the plane of view of FIG. 7. The sliding vane 124 impacts an external surface 120E of a rolling piston 120. In the sliding vane 124, the hole 124H is eccentric and, more specifically, the axis of symmetry 125 of the hole 124H is disposed on the high pressure side of the vane 124, meaning that the axis of symmetry 125 is closer to a compression chamber 136 on the left side (in the view of FIG. 7) of the vane 124. By locating the hole 124H towards the high pressure side of the vane 124, the compliance is provided in the most advantageous location. In particular, most of the high frequency noise is felt with the rolling piston on this portion of the tip 140 and, therefore, positioning the hole 124H in this manner will best soften the impacts and may provide the best improvement in the noise characteristics.

Figure 8:
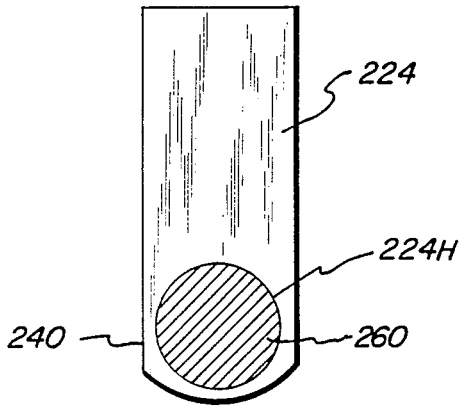
FIG. 8 shows another embodiment vane wherein a hole is filled with filler material.

With reference now to FIG. 8, a sliding vane 224 is shown wherein the hole 224H at tip 240 includes a filler material 260. Various materials might be used within the hole or cavity 224H in order to provide added dampening or, alternately, for increased stiffening. The increased stiffening might be used to increase a frequency over 10 khZ, instead of lowering it. That is, although the previous discussion has concentrated on the use of cavities in order to lower the frequency in the manner suggested by the difference in results of FIG. 4 and FIG. 6, a particular rotary compressor might have frequency characteristics making it advantageous to increase the frequency of the noise, instead of lowering it. This might be accomplished by adding a particular filler material 260 which was very rigid.

Among materials which might be used as fillers 260 for raising or lowering the noise frequency resulting from the impact of the sliding vane 224 would be polymers, ceramics, and various metals.

Either of vanes 124 and 224 could be used in place of vane 24 in the arrangement of FIGS. 1 and 2.

Although various specific constructions have been disclosed herein, it is to be understood that these are for illustrative purposes only. Various modifications and adaptations will be apparent to those of skill in the art. Accordingly, the scope of the present invention should be determined by reference to the claims appended hereto.

What is claimed is:

1. A rotary compressor comprising:

a cylindrical wall; a compression chamber within said cylindrical wall and having a width;

a rolling piston mounted for eccentric rotation about a rotation axis within said cylindrical wall, said rotation axis being parallel to the width of said compression chamber; and a vane slidably mounted in a slot in said cylindrical wall, said vane being of integral construction between and including opposite sides which slide directly adjacent opposite sides of said slot, said vane having a tip impacting an external surface of said rolling piston; and wherein said rolling piston includes an internal surface, and the rotary compressor has a cavity operable to affect the compliance of impact surfaces at the site of impact between said tip of said vane and said rolling piston, and said cavity is disposed in said tip of said vane, and wherein said cavity is bounded by said vane in a closed loop in any cross-section taken in a plane perpendicular to said rotation axis.

2. The rotary compressor of claim 1 wherein said cavity extends in the width direction completely across the width of the compression chamber and completely through said vane.

3. The rotary compressor of claim 1 wherein said cavity is hollow.

4. The rotary compressor of claim 1 wherein said cavity is offset from a vane center line and said cavity has a center line closer to said compression chamber than said vane center line.

5. The rotary compressor of claim 1 wherein said cavity is filled with a fixed filler to affect the compliance of said impact surfaces.

6. The rotary compressor of claim 1 wherein said cavity is a cylindrical hole having a central axis parallel to said rotation axis.

7. The rotary compressor of claim 1 wherein said rolling piston has a plurality of slots disposed between said internal surface of said rolling piston and said external surface of said rolling piston.

8. The rotary compressor of claim 1 wherein said cavity is non-communicating.

9. The rotary compressor of claim 10 wherein said rolling piston is of integral construction between and including said external surface and said internal surface.

10. A rotary compressor comprising:

a cylindrical wall;

a compression chamber within aid cylindrical wall and having a width;

a rolling piston mounted for eccentric rotation about a rotation axis within said cylindrical wall and having an external surface and an internal surface, said rolling piston being of integral construction between and including said external surface and said internal surface, said rotation axis being parallel to the width of said compression chamber; and a vane slidably mounted in a slot in said cylindrical wall, said vane being of integral construction between and including opposite sides which slide directly adjacent opposite sides of said slot, said vane having a tip impacting said external surface of said rolling piston; and wherein said rolling piston has a cavity disposed in said rolling piston between said external surface and said internal surface, said cavity operable to affect the compliance of impact surfaces at the site of impact between said tip of said vane and said rolling piston, and wherein said cavity is enclosed by said rolling piston in a closed loop in any cross-section taken in a plane perpendicular to said rotation axis, and wherein said tip of said vane has a hole operable to affect the compliance of impact surfaces at the site of impact between said tip of said vane and said rolling piston.

11. The rotary compressor of claim 10 wherein said hole is bounded by said vane in a closed loop in any cross-section taken in a plane perpendicular to said rotation axis.

12. The rotary compressor of claim 10 wherein said cavity is non-communicating.

13. The rotary compressor of claim 10 wherein said cavity is a slot, and said rolling piston further includes a plurality of additional slots between said external surface and said internal surface, each additional slot being operable to affect the compliance of impact surfaces at the site of impact between said tip of said vane and said rolling piston and being bounded by said rolling piston in a closed loop in any cross-section taken in a plane perpendicular to said rotation axis.

14. The rotary compressor of claim 13 wherein each of said slots extends in the width direction completely across the width of the compression chamber and completely through said rolling piston.

15. A rotary compressor comprising:

a cylindrical wall; a compression chamber within said cylindrical wall and having a width;

a rolling piston mounted for eccentric rotation about a rotation axis within said cylindrical wall, said rotation axis being parallel to the width of said compression chamber; and a vane slidably mounted in a slot in said cylindrical wall, said vane being of integral construction between and including opposite sides which slide directly adjacent opposite sides of said slot, said vane having a tip impacting an external surface of said rolling piston; and wherein said rolling piston includes an internal surface, and the rotary compressor has a cavity operable to affect the compliance of impact surfaces at the site of impact between said tip of said vane and said rolling piston, said cavity being disposed outwardly from said internal surface of said rolling piston, and said cavity extending substantially in the direction of the width of said compression chamber, and wherein said cavity is a hole disposed in said tip of said vane, and wherein said cavity is bounded by the vane in a closed loop in any cross-section taken in a plane perpendicular to said rotation axis, and wherein said rolling piston has a plurality of slots disposed between said internal surface of said rolling piston and said external surface of said rolling piston and operable to affect the compliance of said impact surfaces, and wherein the rolling piston is of integral construction between and including said external surface and said internal surface.

16. The rotary compressor of claim 15 wherein said cavity extends in the width direction completely across the width of the compression chamber and completely through said vane.

17. The rotary compressor of claim 15 wherein said cavity is hollow.

18. The rotary compressor of claim 15 wherein said cavity is filled with a fixed filler to affect the compliance of said impact surfaces.

19. The rotary compressor of claim 15 wherein said cavity is a non-communicating cavity and said plurality of slots are non-communicating.

* * * * *